US005561341A

United States Patent [19]

Won

[11] Patent Number: 5,561,341

[45] Date of Patent: Oct. 1, 1996

[54] CATHODE RAY TUBE WITH IMPROVED ELECTRICAL CONNECTION MEANS

[75] Inventor: Chang-sik Won, Kyunggi-do, Rep. of Korea

[73] Assignee: Samsung Electron Devices Co., Ltd., Kyunggi-do, Rep. of Korea

[21] Appl. No.: 875,302

[22] Filed: Apr. 29, 1992

[30] Foreign Application Priority Data

Jul. 13, 1991 [KR] Rep. of Korea ..... 91-10846

[51] Int. Cl.[6] ..... H01J 29/80

[52] U.S. Cl. ..... 313/406; 313/404; 313/407

[58] Field of Search ..... 313/402, 404, 313/405, 406, 407, 479

[56] References Cited

U.S. PATENT DOCUMENTS

| | | | |
|---|---|---|---|
| 4,139,215 | 2/1979 | Adamson et al. | 313/466 |
| 4,243,908 | 1/1981 | Brenner, Jr. | 313/407 |
| 4,333,033 | 6/1982 | Cordingley et al. | 313/406 |
| 4,670,686 | 6/1987 | Muenkel et al. | 313/407 |
| 4,829,212 | 5/1989 | Slilo et al. | 313/406 |
| 5,087,855 | 2/1992 | Overbeek et al. | 313/479 |
| 5,126,624 | 6/1992 | Ji | 313/407 |
| 5,218,266 | 6/1993 | Lee | 313/404 |

*Primary Examiner*—Sandra L. O'Shea
*Assistant Examiner*—Vip Patel
*Attorney, Agent, or Firm*—Leydig, Voit & Mayer

[57] ABSTRACT

A cathode ray tube relates to the improvement of its contact spring for grounding thermoelectrons remaining on a phosphor layer to an external anode, and the coupling structure of the contact spring. One end of the contact spring whose other end has a circular contact portion in contact with a graphite conductive layer of a funnel extends a predetermined length to form a contact portion in contact with an aluminum deposited layer of a panel. A contact spring coupling unit is formed at the center of the body of the contact spring and one side of the frame of a shadow mask frame assembly. The graphite layer formation process for electrically connecting the aluminum deposited layer and a stud pin can be eliminated, and the inferiority caused by choking of the electron beam passing holes of the shadow mask produced during welding the contact spring can be prevented which enhances productivity and quality of the end product.

10 Claims, 4 Drawing Sheets

CATHODE RAY TUBE WITH IMPROVED ELECTRICAL CONNECTION MEANS

BACKGROUND OF THE INVENTION

The present invention relates to a cathode ray tube, and particularly to a cathode ray tube wherein a contact spring for grounding thermoelectrons remaining on a phosphor layer to an external anode electrode and the coupling structure of the contact spring and cathode ray tube are improved.

Generally, as shown in FIG. 1, a cathode ray tube has an envelope formed by a funnel 2 and a panel 3. An electron gun 4 is inserted into a neck 2*a* provided at the rear end of funnel 2, and a graphite conductive layer 2*b* is formed on the inner surface of funnel 2. A phosphor layer 3*a* is formed on the inner surface of panel 3, and a plurality of stud pins 5 are installed inside of a skirt 3*d* at the periphery of phosphor layer 3*a*. Also, a shadow mask frame assembly 7' has a hook spring 6' coupled with stud pin 5 at each corner of the inner space of panel 3. A contact spring 9 having a circular contact portion 9*a* at its end in contact with graphite conductive layer 2*b* of funnel 2 is fixed on one side of a frame 8' of shadow mask frame assembly 7'.

In conventional cathode ray tube constructed as the above, electron beams emitted from electron gun 4 mounted on neck 2*a* of funnel 2 pass through the shadow mask, and then land on phosphor layer 3*a*, thereby forming a pixel. However, residual thermoelectrons remaining after illuminating phosphors on phosphor layer 3*a* impede the landing of succeeding thermoelectrons emitted from electron gun 4 on phosphor layer 3*a*. Thus, the residual thermoelectrons remaining after illuminating the phosphors on phosphor layer 3*a* are bypassed to the common ground of the circuit of the cathode ray tube.

In more detail, the residual thermoelectrons remaining after phosphor illumination are bypassed to the common ground of the circuit of the cathode ray tube via an aluminum deposited layer on the surface of a phosphor layer, a stud pin electrically connected to the aluminum deposited layer, a hook spring on which the stud pin is hooked, a frame to which the hook spring is fixed, a contact spring whose one end is fixed to the frame, a graphite conductive layer on the inner surface of a funnel which makes contact with the other end of the contact spring, and an anode electrically in contact with the graphite conductive layer, in sequence. Among the elements constituting the path for passing the thermoelectrons, since graphite conductive layer 3*c* which connects phosphor layer 3*a*, aluminum depositing layer 3*b*, and stud pin 5 as shown in FIG. 1 is a kind of coating film which is formed by a spray-on method or is brushed on by hand, the layer is easily separated from skirt 3*d* of panel 3 or the coating becomes ununiform which prevents the thermoelectrons from being smoothly passed. Such an inconsistent coating condition causes the thermoelectrons to not be completely passed under certain circumstances. Moreover, the graphite is frequently splashed onto the phosphor layer during its application, so that the manufactured product cannot be used due to the graphite contamination of the phosphor layer. In addition, contact spring 9 is fixed to frame 8' by an electric resistance welding process, in which foreign matter produced by sparks during welding remains on the shadow mask, thus clogging the beam passing holes of the shadow mask.

SUMMARY OF THE INVENTION

It is the object of the present invention to provide a cathode ray tube having an improved structure, wherein the conventional process for forming a graphite layer which connects an aluminum deposited layer and a stud pin is omitted, and clogging of the beam passing holes of a shadow mask occurring while installing a contact spring is prevented.

To achieve the above and other objects of the present invention, there is provided a cathode ray tube including a panel which has a phosphor layer and an aluminum layer stacked on the inner surface of the panel, and a plurality of stud pins on the inner sides thereof, a shadow mask frame assembly having a hook spring coupled with the stud pin at the periphery of the shadow mask frame assembly, a funnel sealed with the panel and coated with a graphite conductive layer on the inner surface thereof, and a contact spring coupled with the frame of the shadow mask frame assembly, whose one end is in contact with the graphite conductive layer of the funnel, the cathode ray tube comprising:

a contact portion in contact with the aluminum deposited layer of the panel by extending a predetermined length from the other end of the contact spring; and contact spring coupling means provided at the center of the body of the contact spring and one side of the frame of the shadow mask frame assembly.

BRIEF DESCRIPTION OF THE DRAWINGS

These and other objects, features, aspects and advantages of the present invention will become more apparent when taken in conjunction with the accompanying drawings, in which.

DETAILED DESCRIPTION OF THE INVENTION

Figure 1:
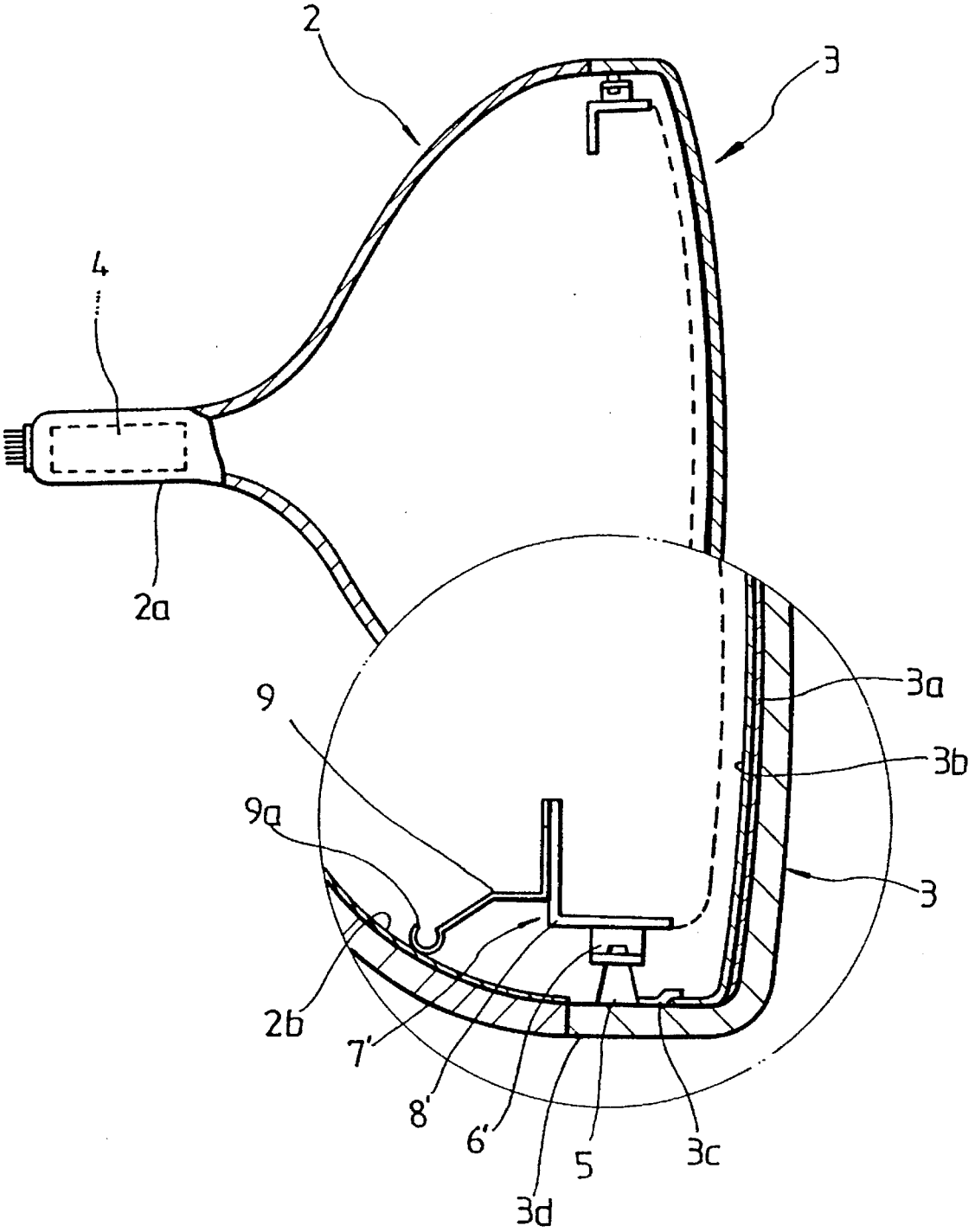
FIG.1(PRIOR ART)
FIG. 1 is a partially cutaway sectional side view of a conventional cathode ray tube.
Figure 2:
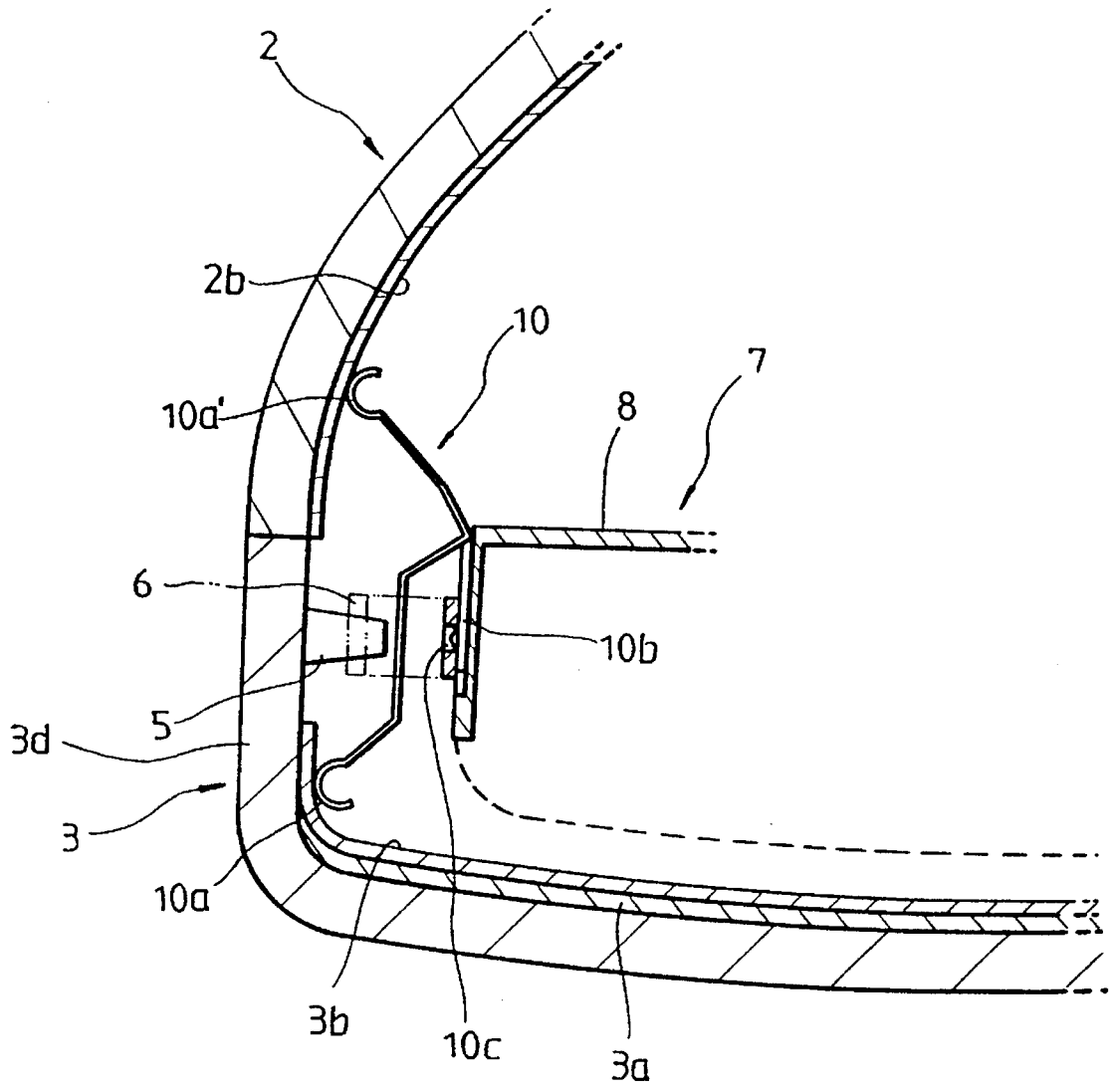
FIG. 2 is a partially cutaway sectional view showing a cathode ray tube according to the present invention.
Figure 3:
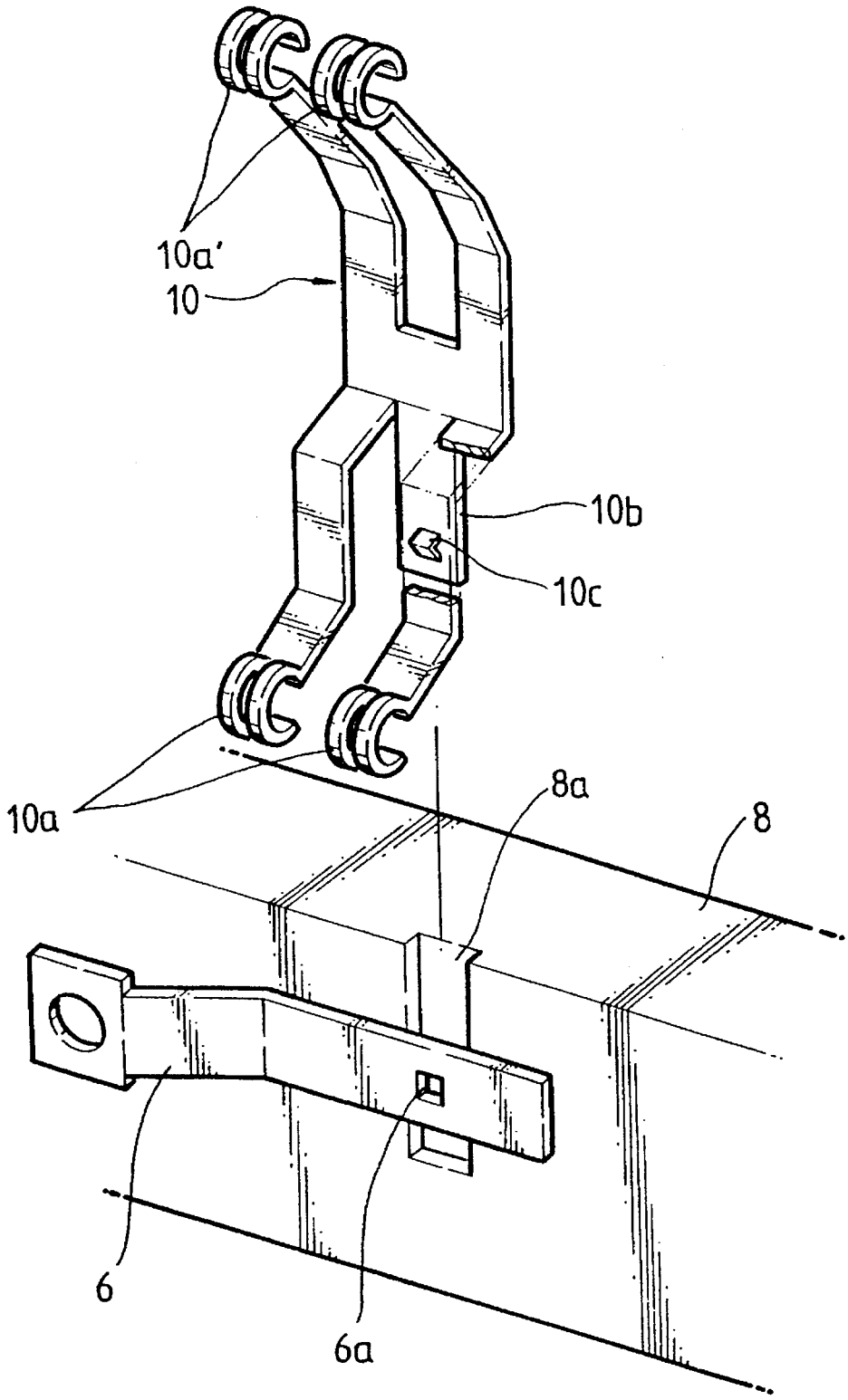
FIG. 3 is a separated perspective view showing one embodiment of the coupling structure of the contact spring and frame of FIG. 2.

In FIGS. 2 and 3, a cathode ray tube according to the present invention is formed such that a phosphor layer 3*a* and an aluminum deposited layer 3*b* are sequentially stacked on the inner surface of panel 3, and a plurality of stud pins 5 are installed inside of a skirt 3*d* at the periphery of panel 3. Also, a shadow mask frame assembly 7 which has a hook spring 6 coupled with stud pin 5 is installed in the inner space of panel 3. A graphite conductive layer 2*b* is formed on the inner surface of a funnel 2 sealed with panel 3. A contact spring 10 is detachably installed on one side of a frame 8 of shadow mask frame assembly 7 via a coupling unit. Here, contact spring 10 has a pair of circular contact portions 10*a'* and 10*a* at each end, wherein one end (10*a'*) is in contact with graphite conductive layer 2*b* of funnel 2 and the other end (10*a*) is in contact with aluminum deposited layer 3*b* of panel 3.

The coupling unit of contact spring 10 includes a tab-shaped coupling plate 10*b* extending from the center of the contact spring's body at a predetermined length and having an elastic protrusion 10*c*. A channel-shaped coupling groove 8*a* is formed in one side of frame 8 corresponding to coupling plate 10*b*, and a hook spring 6 whose rearward portion bridges coupling groove 8*a*, and is provided with a coupling hole 6*a* so as to be corresponding to elastic protrusion 10*c*.

Preferably, circular contact portions 10*a* and 10*a*' are formed by lengthwise-cutting at a predetermined length in order to be in stable contact with graphite conductive layer 2*b* and aluminum deposited layer 3*b*, and elastic protrusion 10*c* is formed by a pressing process of coupling plate 10*b*.

In the cathode ray tube formed as above, when coupling plate 10*b* of contact spring 10 is inserted into coupling groove 8*a* formed in frame 8 of shadow mask frame assembly 7, elastic protrusion 10*c* of coupling plate 10*b* is fitted into coupling hole 6*a* of hook spring 6 which is welded to frame 8, so that contact spring 10 is firmly coupled with frame 8. Accordingly, clogging of the electron beam passing holes of the shadow mask caused during conventional welding is prevented. Also, under these conditions, when hook spring 6 of shadow mask frame assembly 7 is coupled with stud pin 5 provided on the inner surface of panel 3 to place shadow mask frame assembly 7 within panel 3, circular contact portion 10*a* formed at the other end of contact spring 10 at a predetermined length makes tight contact with aluminum deposited layer 3*b* on the inner surface of panel 3 by the inherent elastic property of the material. Therefore, with this simple coupling process of shadow mask frame assembly 7 to the inner surface of panel 3, aluminum deposited layer 3*b* is electrically connected to stud pin 5.

Figure 4:
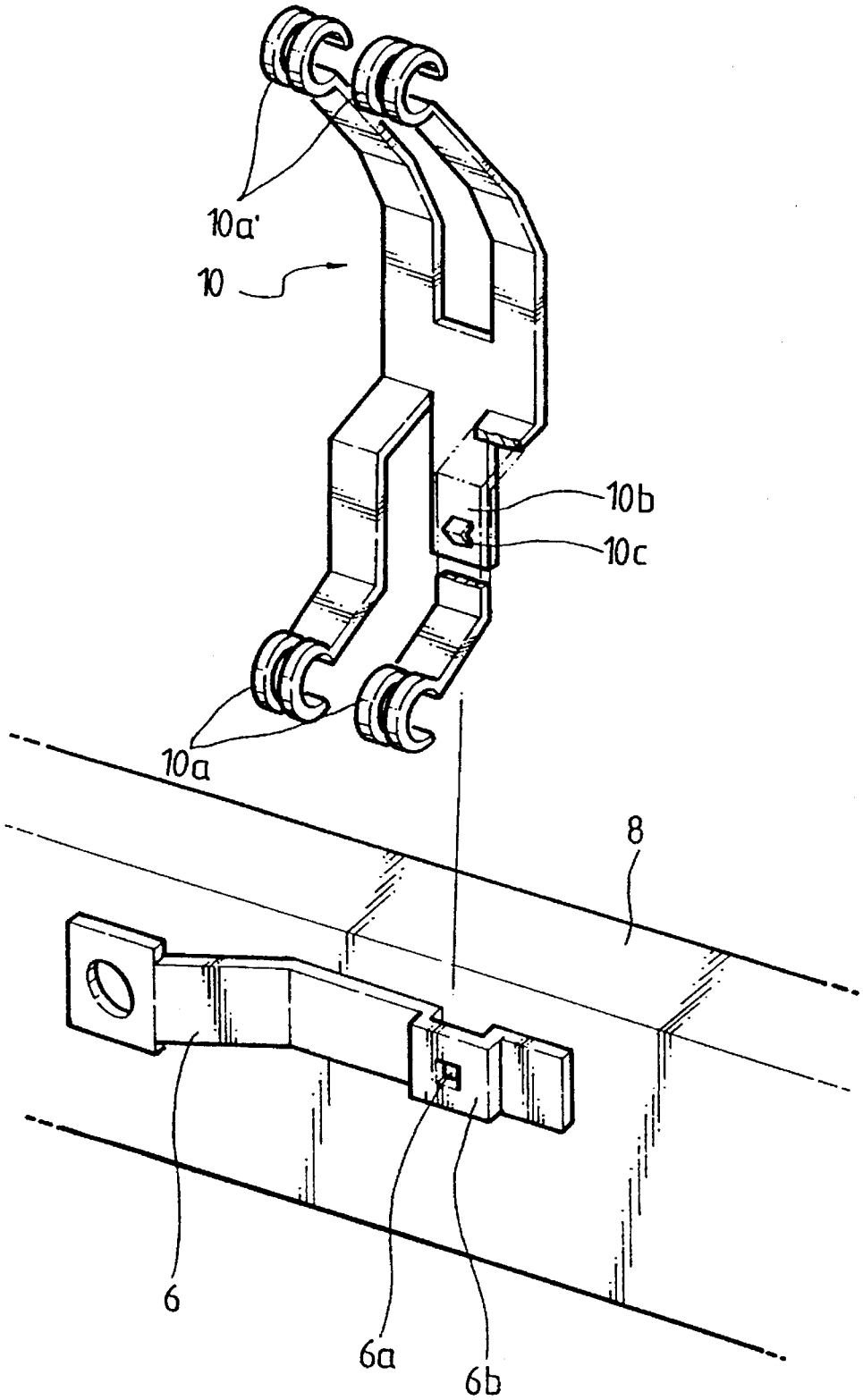
FIG. 4 is a separated perspective view showing another embodiment of the present invention.

In addition, as illustrated in FIG. 4, the same effect can be obtained by forming a channel-shaped bent portion 6*b* which is adapted to receive a tab-shaped coupling of contact spring 10 and formed with a coupling hole 6*a* for receiving the elastic protrusion 10*c* of contact spring 10. This is in lieu of, as in FIG. 3 carving, coupling groove 8*a* into the frame.

According to the present invention as described above, a circular contact portion in contact with the aluminum deposited layer of the panel is formed at one end of the contact spring whose other end is another circular contact portion in contact with the graphite conductive layer of the funnel, and the contact spring is detachably coupled with the frame by the coupling unit, so that the deposition or coating process of the graphite between the stud pin and aluminum deposited layer is omitted. Therefore, the aforementioned inferior phosphor layer can be basically solved, which is caused by inferior depositing/coating, or the splashing of the graphite on the phosphor layer. Furthermore, the coupling structure of the contact spring to the frame is simple and secure, so that clogging of the beam passing holes of the shadow mask produced during performing the conventional welding can be prevented, which enhances productivity and quality of the end product.

What is claimed is:

1. A cathode ray tube comprising:

a panel having an inner surface and an outer surface;

a phosphor layer and an aluminum layer stacked upon each other and substantially covering the inner surface of said panel;

a plurality of stud pins disposed on the periphery of the inner surface of said panel;

a shadow mask frame assembly;

a hook spring coupling said stud pin with said shadow mask frame assembly;

a funnel sealed with said panel and coated with a graphite conductive layer on an inner surface thereof; and a contact spring having first and second end portions, said contact spring coupled with said shadow mask frame assembly between said end portions so that the first end portion is in contact with the graphite conductive layer of said funnel and the second end portion is in contact with the aluminum deposited layer of said panel; and means for coupling said contact spring with said shadow mask frame assembly provided at the center of the body of said contact spring and one side of the frame of said shadow mask frame assembly.

2. A cathode ray tube as claimed in claim 1, wherein said means for coupling said contact spring comprises:

a tab-shaped coupling plate which extends from a center portion of said contact spring by a predetermined length, including an elastic protrusion projecting from said tab-shaped coupling plate;

a channel-shaped coupling groove formed on one side of said shadow mask frame assembly corresponding to the shape of said coupling plate wherein said hook spring includes a rearward end which bridges said channel-shaped coupling groove, and is provided with a coupling aperture located in said bridging portion so as to be approximately centered over said channel-shaped coupling groove for engaging the elastic protrusion of said tab-shaped coupling plate.

3. A cathode ray tube as claimed in claim 1, wherein said means for coupling said contact spring comprises:

a tab-shaped coupling plate which extends from a center portion of said contact spring by a predetermined length, including an elastic protrusion projecting from said tab-shaped coupling plate wherein said hook spring has a channel-shaped bent portion for receiving said coupling plate and a coupling aperture in said bent portion for engaging the elastic protrusion of said tab-shaped coupling plate.

4. A cathode ray tube comprising:

a panel having an inner surface and an outer surface;

a phosphor layer and an aluminum layer stacked upon each other and substantially covering the inner surface of said panel;

a plurality of stud pins connected to said panel along a periphery of said panel;

a shadow mask frame assembly having a number of legs wherein a selected leg has a channel-shaped groove formed therein;

a first biasing member coupling said stud pin with said shadow mask frame assembly, said first biasing member including a rearward portion which bridges said channel-shaped coupling groove and is provided with a coupling aperture located in the rearward portion so as to oppose the channel-shaped groove of the selected leg of said shadow mask;

a funnel having an inner surface substantially coated with a graphite layer, said funnel being connected to said panel;

a second biasing member comprising first and second end portions, the first end portion being in contact with the graphite conductive layer of said funnel and the second end portion being in contact with aluminum layer of said panel, a tab-like projection, and an elastic notch element projecting from the tab-like projection wherein the elastic notch engages the coupling aperture of said first biasing member and the tab-like projecting element engages the channel shaped groove of said shadow mask assembly.

5. A cathode ray tube comprising:

a panel having an inner surface and an outer surface;

a phosphor layer and an aluminum layer stacked upon each other and substantially covering the inner surface of said panel;

a plurality of stud pins connected to said panel along a periphery of said panel;

a shadow mask frame assembly having a number of legs;

a first biasing member coupling said stud pin with said shadow mask frame assembly, said first biasing member including a bent rearward portion which bridges said channel-shaped coupling groove and is provided with a coupling aperture located in the bent rearward portion;

a funnel having an inner surface substantially coated with a graphite layer, said funnel being connected to said panel;

a second biasing member comprising first and second end portions, the first end portion being in contact with the graphite conductive layer of said funnel and the second end portion being in contact with aluminum layer of said panel, a tab-like projection, and an elastic notch element projecting from the tab-like projection wherein the elastic notch engages the coupling aperture of said first biasing member and the tab-like projecting element engages the bent rearward portion of said first biasing member.

6. A cathode ray tube comprising:

a panel having an inner surface and an outer surface;

a phosphor layer and an aluminum layer stacked upon each other and substantially covering the inner surface of said panel;

a plurality of stud pins connected to said panel along a periphery of said panel;

a shadow mask frame assembly;

a first biasing member coupling said stud pin with said shadow mask frame assembly;

a funnel having an inner surface substantially coated with a graphite layer, said funnel being connected to said panel;

a second biasing member comprising first and second end portions, the first end portion being in contact with the graphite conductive layer of said funnel and the second end portion being in contact with aluminum layer of said panel; and means for coupling said second biasing member with said shadow mask frame assembly.

7. A cathode ray tube as claimed in claim 6 wherein said first biasing member is a hook spring.

8. A cathode ray tube as claimed in claim 6 wherein said second biasing member is a contact spring.

9. A cathode ray tube as claimed in claim 6 wherein said means for coupling said second biasing member comprises:

a tab-shaped coupling plate which extends from a center portion of said second biasing member by a predetermined length, including an elastic protrusion projecting from said tab-shaped coupling plate;

a channel-shaped coupling groove formed in said shadow mask frame assembly corresponding to the shape of said coupling plate wherein said first biasing member includes a rearward end which bridges said channel-shaped coupling groove and is provided with a coupling aperture located in said bridging portion so as to be approximately centered over said channel-shaped coupling groove for engaging the elastic protrusion of said tab-shaped coupling plate.

10. A cathode ray tube as claimed in claim 6 wherein said means for coupling said second biasing member comprises a tab-shaped coupling plate which extends from a center portion of said second biasing member by a predetermined length, including an elastic protrusion projecting from said tab-shaped coupling plate wherein said first biasing member has a channel-shaped bent portion for receiving said coupling plate and a coupling aperture in said bent portion for engaging the elastic protrusion of said tab-shaped coupling plate.

* * * * *